US005823267A

United States Patent [19]

Burge et al.

[11] Patent Number: 5,823,267

[45] Date of Patent: Oct. 20, 1998

[54] UNIVERSAL PIPE AND TUBING INJECTION APPARATUS AND METHOD

[75] Inventors: Philip Burge, Chiswick; Peter Fontana, Drayton Gardens; Glenn Leroux, Roehampton, all of European Pat. Off.; Friedhelm Makohl, Hermannsburg, Germany

[73] Assignee: Baker Hughes Incorporated, Houston, Tex.

[21] Appl. No.: 915,346

[22] Filed: Aug. 22, 1997

Related U.S. Application Data

[60] Division of Ser. No. 600,842, Feb. 13, 1996, Pat. No. 5,738,173, which is a continuation-in-part of Ser. No. 402,117, Mar. 10, 1995, abandoned, and a continuation-in-part of Ser. No. 524,984, Sep. 8, 1995, abandoned, and a continuation-in-part of Ser. No. 543,683, Oct. 16, 1995, abandoned.

[51] Int. Cl.[6] ..... E21B 19/22

[52] U.S. Cl. ..... 166/385; 166/77.2; 242/577.2

[58] Field of Search ..... 242/577.2, 607.1; 166/384, 385, 77.2, 77.3

[56] References Cited

U.S. PATENT DOCUMENTS

| | | | |
|---|---|---|---|
| 1,656,215 | 1/1928 | McDonald . | |
| 1,886,209 | 11/1932 | Vest . | |
| 2,041,214 | 5/1936 | Shorrock | 242/577.2 |
| 2,555,851 | 6/1951 | Hancock | 242/115 |
| 2,797,880 | 7/1957 | Miller | 242/110 |
| 2,960,311 | 11/1960 | Scott | 255/19 |
| 3,009,521 | 11/1961 | Failing | 175/127 |
| 3,058,688 | 10/1962 | Abel | 242/577.2 |
| 3,282,530 | 11/1966 | Rash | 242/577.2 |

(List continued on next page.)

FOREIGN PATENT DOCUMENTS

| | | |
|---|---|---|
| 2 055 781 | 4/1971 | France . |
| 955 193 | 4/1964 | United Kingdom . |
| 996 063 | 6/1965 | United Kingdom . |
| 2 183 600 | 6/1987 | United Kingdom . |
| 2 238 294 | 5/1991 | United Kingdom . |
| 92/18 741 | 10/1992 | WIPO . |

OTHER PUBLICATIONS

Burge, Phil: *Modular Rig System—Advances in CTD/SHD Rigs*; 10 pages; Oct. 17, 1995; Second European Coiled Tubing Roundtable.

*Shell Pressing Coiled Tubing Programs in California*; pp. 31–32; Jun. 27, 1994; Oil & Gas Journal.

Koen, A. D.; *Use of Coiled Tubing Fans Out Among Well Sites of the World*; pp. 18–22; Oct. 3, 1994; Oil & Gas Journal.

Sas–Jaworsky, Alexander; *Coiled Tubing—Operations and Services*; pp. 41–47; Nov. 1991; World Oil, vol. 212, No. 11.

*Primary Examiner*—William P. Neuder
*Attorney, Agent, or Firm*—Gerald W. Spinks

[57] ABSTRACT

An apparatus for injection of coiled tubing or jointed tubulars into a well bore, using an injector head capable of handling either type of tubular. The injector head and a working platform are mounted on a structure over the well head, with the injector being positioned so as to allow personnel access to the tubing on the working platform without having to relocate the injector head away from the well head location. The injector can be mounted below the working platform, or it can be mounted spaced above the working platform on a vertically movable trolley on a mast. When the injector is mounted below the working platform, the tubulars and any bottom hole assembly are accessible to personnel on top of the working platform, whether coiled tubing or jointed tubulars are being used. When the vertically movable trolley is used for coiled tubing operations, the injector head can be lowered to the working platform for injection or pulling operations, and it can be raised above the working platform to give access to the tubing and the bottom hole assembly. When the vertically movable trolley is used for jointed tubular operations, the injector head can be raised above the working platform for all phases, and a movable mandrel can be used in the injector head for raising or lowering the jointed tubulars.

10 Claims, 10 Drawing Sheets

U.S. PATENT DOCUMENTS

| | | | |
|---|---|---|---|
| 3,313,346 | 4/1967 | Cross | 166/5 |
| 3,363,880 | 1/1968 | Blagg | 254/135 |
| 3,494,211 | 2/1970 | Reynard | 74/230.24 |
| 3,504,866 | 4/1970 | Palynchuk | 242/86.5 |
| 3,614,019 | 10/1971 | Slator | 242/157.1 |
| 3,841,407 | 10/1974 | Bozeman | 166/315 |
| 3,884,311 | 5/1975 | Eddy | 173/57 |
| 4,154,310 | 5/1979 | Konstantinovsky | 175/40 |
| 4,463,814 | 8/1984 | Horstmeyer et al. | 175/45 |
| 4,515,220 | 5/1985 | Sizer et al. | 166/384 |
| 4,585,061 | 4/1986 | Lyons | 166/77 |
| 4,640,353 | 2/1987 | Schuh | 166/77.2 X |
| 4,655,291 | 4/1987 | Cox | 166/385 |
| 4,673,035 | 6/1987 | Gipson | 166/77.2 |
| 4,899,823 | 2/1990 | Cobb | 166/351 |
| 5,002,130 | 3/1991 | Laky | 166/351 |
| 5,094,340 | 3/1992 | Avakov | 198/626.1 |
| 5,133,405 | 7/1992 | Elliston | 166/77.3 |
| 5,215,151 | 6/1993 | Smith et al. | 175/45 |
| 5,244,046 | 9/1993 | Council et al. | 166/380 |
| 5,287,921 | 2/1994 | Blount et al. | 166/117.6 |
| 5,291,956 | 3/1994 | Mueller et al. | 175/67 |
| 5,309,990 | 5/1994 | Lance | 166/77.3 |
| 5,311,952 | 5/1994 | Eddison et al. | 175/61 |
| 5,339,913 | 8/1994 | Rives | 175/73 |
| 5,370,180 | 12/1994 | Barbee | 166/178 |
| 5,411,085 | 5/1995 | Moore et al. | 166/77.2 X |
| 5,454,419 | 10/1995 | Vloedman | 166/77.2 X |

UNIVERSAL PIPE AND TUBING INJECTION APPARATUS AND METHOD

CROSS REFERENCE TO RELATED APPLICATIONS

This is a division of patent application Ser. No. 08/600,842, filed Feb. 13, 1996, now U.S. Pat. No. 5,738,173, titled Universal Pipe and Tubing Injection Apparatus and Method; which is a continuation-in-part of patent application. Ser. Nos. 08/402,117, filed Mar. 10, 1995, titled Modular Rig Design, now abandoned; 08/524,984, filed Sep. 8, 1995, titled Modular Rig Design, now abandoned; and 08/543,683, filed Oct. 16, 1995, titled Coiled Tubing Apparatus, now abandoned; and which claims priority from Provisional Application Ser. No. 60/007,229, filed Nov. 3, 1995, titled Jointed Tubing Injection Apparatus and Method.

BACKGROUND OF THE INVENTION

This invention relates to the use and handling of jointed pipe, jointed tubing, and coiled tubing in various well operations. More specifically, the invention relates to the selective handling and running of different types of pipe and tubing in well drilling and well servicing operations, with a universal apparatus incorporating a chain drive tubing injector designed for injecting and pulling jointed tubulars as well as coiled tubing. All jointed tubulars are referred to herein as jointed tubing.

Jointed pipe and jointed tubing are typically run into wells, as drill pipe, production tubing, or casing, during well drilling or servicing operations, using either a drilling rig or a workover rig. Such rigs can be expensive and time consuming to use. To help minimize the time and expense typically involved in using jointed piped or jointed tubing, coiled tubing is sometimes used instead. Various kinds of downhole equipment, such as stabilizers, drill motors, and bits, can be attached to the end of the jointed tubulars or to the coiled tubing, depending upon what type of bottom hole assembly is used.

In early applications of such coiled tubing use, the coiled tubing used was of a relatively small diameter, typically approximately one inch. The use of such small diameter tubing provides the maximum amount of tubing which can possibly be mounted on a reel to be transported to and from the well site. This is important, because the size of the reel which can be transported to the well site is limited by regulations governing the roads over which the reel is to be transported. However, the use of such small diameter coiled tubing limits the flow of fluids therethrough, limits the amount of compression force that can be transmitted through the string of tubing in the well, limits the amount of tension that can be placed on the string of tubing, limits the amount of torque that the tubing can withstand, limits the type and weight of tools that may be used, and even limits the length of tubing that may be used.

Therefore, larger sizes of coiled tubing have come into use, in diameters ranging up to three and one-half inches, or even higher. However, the use of such larger diameter coiled tubing with small reels and handling apparatus designed for the smaller diameter tubing creates problems.

Conventional coiled tubing handling equipment typically comprises a reel of coiled tubing mounted on a platform or vehicle, an injector to run the tubing into and out of the well, a gooseneck permanently affixed to the injector for guiding the coiled tubing between the reel and the injector, a lifting device to support the injector and the gooseneck, a hydraulic power pack to provide power to the reel and the injector and to other hydraulic equipment, and surface equipment such as strippers and blow-out preventors to seal around the coiled tubing as it is run into and out of the well. The vehicle used to transport the reel is typically a trailer or a skid. The reel may be of various sizes, depending upon the size of the coiled tubing to be reeled thereupon, and the length of coiled tubing to be carried. As mentioned above, the reel on which the coiled tubing is shipped is limited primarily by government regulation of roads over which the tubing is to be shipped. Therefore, even large diameter tubing must be shipped on relatively small diameter reels. Typically, the tubing is used at the well site on the same reel on which it was shipped. This can involve repeated reeling and unreeling of large diameter coiled tubing on a small reel, increasing the fatigue from bending stresses.

The lifting device used to support the injector and the gooseneck is typically a hydraulically powered boom or crane located at the rear of the coiled tubing trailer so that it may be located over the well. The hydraulically powered injector has drive chains with tubing grippers located thereon. The drive chains are hydraulically pressed against the tubing to grip the tubing; hydraulically driven sprockets drive the chains to run the tubing into or out of the well. The hydraulic power pack comprises one or more engines driving one or more hydraulic pumps to power the reel, the crane, the injector, and other equipment. Other types of power equipment can also be substituted for hydraulic equipment.

Injectors are known which can handle various diameters of coiled tubing. However, the goosenecks commonly in use are typically designed for relatively small diameter coiled tubing. A typical gooseneck comprises a curved guide member, with the radius of the curve being relatively small, and with the curve covering an arc of approximately ninety degrees (90°) or less. This guide member receives a reach of tubing extending approximately horizontally from the reel, uncoils the tubing from the reel, and guides the tubing between the drive chains of the injector. The gooseneck usually includes a plurality of rollers for supporting the tubing while the tubing is being guided by the gooseneck into the injector. Use of the larger diameters of coiled tubing often results in unnecessary stresses being placed on the tubing by the small radius bends typically found in the goosenecks affixed to injectors.

In known systems, the gooseneck is permanently attached to the injector, and the injector and gooseneck are usually suspended by the crane as a unit, over the well. This requires that the assembly and disassembly of equipment in the bottom hole assembly be accomplished under the suspended injector after the coiled tubing has been run through the gooseneck and the injector. Therefore, the crane must lift the injector and the gooseneck to give workers access to perform the assembly and disassembly of bottom hole equipment. This creates a difficult and sometimes hazardous working environment in a confined area surrounded by well service equipment.

Further, in a servicing application where the well bore is under pressure, introduction of a long bottom hole assembly into the well bore can require a long riser pipe, or lubricator assembly, under the injector for pressure isolation purposes. Where used, the lubricator assembly must be long enough to accommodate the bottom hole assembly, or at least long enough to encompass the external flow ports which may be incorporated into the bottom hole assembly. The bottom hole assembly can be lowered into the lubricator, and the upper and lower lubricator valves are used to isolate the bottom hole assembly, or its external ports, to prevent escape of well bore pressure to atmosphere. Where the bottom hole assembly is long, the lubricator assembly appreciably raises the required height of the working platform, raising the required lift height of the injector and gooseneck over the platform.

In some instances, it is required to use jointed pipe, casing, or tubing, in addition to the coiled tubing, in the work string used in the well. In such cases, it is necessary to use a jack-up frame and power tongs to handle the jointed tubulars, in addition to the coiled tubing handling equipment. Normally, the injector and the gooseneck must be mounted on top of the work deck or platform of the jack-up frame, for running the coiled tubing into or out of the well. When it is desired to run the jointed tubulars on such a rig, the injector and gooseneck must be lifted off the platform by the crane and moved to the side to make room for the jointed tubular handling equipment.

It can be seen, then, that currently known well drilling rigs are typically designed to accommodate the handling of only one type of tubular, and coiled tubing shipping and handling equipment is usually best suited only for the smallest diameters of tubing. This has prevented currently known equipment from being used for a variety of purposes. This singularity of purpose has been exacerbated by the fact that the drilling rig design was determined by a drilling contractor, without any consideration being given to other operations that the owner of the well might wish to undertake. The current need to limit costs associated with gas and oil production has led to the need for the provision of universal equipment which will serve as many diverse needs as possible, and this need is particularly acute in the area of drilling and workover equipment. Modularization of such equipment can contribute to the universality of its application. In particular, a universal drilling apparatus should be composed of replaceable modules, with each module being suited, as far as possible, for the handling and running of jointed tubulars as well as coiled tubing, and with the equipment being suited for handling a variety of diameters of tubing.

In order to improve the efficiency of all types of well drilling and servicing operations, then, it is desirable have a single universal set of equipment which will run jointed tubulars of various diameters, and coiled tubing of various diameters, into and out of a well. Ideally, this universal drilling and well servicing equipment should be composed of replaceable modules, with each module being designed for the handling of jointed tubulars as well as coiled tubing. Additionally, the equipment used to handle such jointed tubulars and coiled tubing must occupy the smallest possible space at the well site, and it should be easily transportable.

In using coiled tubing, it is desirable to minimize the amount of bending and plastic deformation of the tubing during its passage through the gooseneck, to help prevent fatigue failure of the tubing. As tubing is unreeled from the reel, it undergoes a first plastic deformation to a straighter configuration, followed immediately by a second plastic deformation in the curve of the guide member to conform roughly to the radius of the curve of the guide member. This is then immediately followed by a third plastic deformation to a relatively straight configuration as the tubing is fed through the injector. The minimum radius through which coiled tubing should be deformed by the guide member is directly proportional to the diameter of the tubing. As mentioned above, in currently known equipment, the gooseneck mounted on an injector is typically designed for use with relatively small diameter coiled tubing. When large diameter coiled tubing is used with such equipment, excessive bending and plastic deformation of the tubing will occur, resulting in early fatigue failure. This results from the fact that the large diameter tubing is being supported and run into a well through approximately the same path as smaller diameter coiled tubing, using a smaller radius of curvature in the gooseneck. Therefore, the universal drilling and servicing apparatus should minimize the plastic deformation of the coiled tubing, being designed to prolong the life of the largest size tubing anticipated for use with the apparatus.

It is an object of the present invention to provide a drilling and well servicing apparatus capable of injecting and pulling either coiled tubing or jointed tubulars through a typical wellhead assembly, with easy access being provided to assemble and disassemble bottom hole assemblies on either type of tubular. It is a further object of the present invention to provide a drilling and well servicing apparatus for injecting and pulling coiled tubing as well as jointed tubulars, wherein the injector head need not be removed from the wellhead or relocated to allow assembly or disassembly of the bottom hole assembly. It is a still further object of the present invention to provide a drilling and well servicing apparatus for injecting and pulling coiled tubing and jointed tubulars, wherein provision is made for handling a wide variety of diameters of coiled tubing in a way which minimizes fatigue of the tubing resulting from repeated plastic deformation. Finally, it is a yet further object of the present invention to provide a drilling and well servicing apparatus for injecting and pulling coiled tubing and jointed tubulars, wherein injection and retrieval of the tubular is not unduly complicated by use on a pressurized well bore.

BRIEF SUMMARY OF THE INVENTION

The present invention is a universal apparatus and method for running jointed tubulars or coiled tubing into and out of a well, wherein the apparatus and method are suitable for running different diameters of tubulars and different types and sizes of bottom hole assemblies. Although universal in nature, the apparatus can have different embodiments in keeping with the concepts of the present invention. By way of example, at least one injector head is provided, mounted to a support structure. A working platform is also mounted to the support structure, positioned relative to the injector head in such a way that personnel are provided access to the tubing. The injector can be mounted beneath a working platform, with the platform providing personnel access to the inlet area immediately atop the injector head. Alternatively, the injector head can be mounted on a vertically adjustable platform or other vertically adjustable structure such as a trolley on a mast. Where the vertically adjustable platform or trolley is used, the injector head is raised and lowered with the platform or trolley to provide personnel access to the tubing beneath the injector head.

Where the injector head is mounted beneath a stationary working platform, two sets of drive chains are arranged in series in the injector head to accommodate jointed tubulars as will be explained below, or two injector heads can be arranged in series for the same purpose. Bottom hole assemblies are assembled and disassembled to jointed tubulars on top of the stationary working platform and run through the injector head. Where the injector head is mounted on a trolley on a mast, a working joint of pipe can be provide as will be explained below, to facilitate the running of jointed tubulars. In this embodiment, bottom hole assemblies can be assembled and disassembled to jointed tubulars beneath the raised injector head. Whether the injector head is mounted to a stationary platform or to a trolley on a mast, personnel access is provided on top of the injector head during the running of coiled tubing. Where the injector head is mounted on a vertically adjustable platform, the platform can be raised to provide access to the bottom hole assembly beneath the injector head, both for coiled tubing or jointed tubulars. In all embodiments, a hydraulic chain drive injector head is illustrated, although other types of injector heads could be adapted for the same purpose in any of these embodiments.

A gooseneck is provided for the running of coiled tubing with the apparatus. The gooseneck is separate from the injector head, but held in alignment with the injector head by a separate structure such as a trolley on a vertical mast. The gooseneck can be independently movable on the mast, or the tubing reel itself can be movable up and down the mast on a trolley, with a small gooseneck mounted on the reel. The gooseneck is formed with a guide member having a sufficiently large radius of curvature that will minimize the bending fatigue imposed on even the largest anticipated diameter of coiled tubing.

Bending fatigue of the coiled tubing is further minimized by the use of an expandable working reel at the well site. The tubing is shipped to the well site on a shipping reel, which is small enough to meet the applicable load limits and size limits on the roads over which the tubing is shipped. For large diameter tubing, this shipping reel is smaller in diameter than is desirable for the repeated coiling and uncoiling that is necessary during coiled tubing operations. Therefore, an expandable working reel is provided at the drill site for use in the drilling or workover operations. The working reel has a support structure and spokes that collapse to a very low profile for shipping to the well site. Once at the site, the working reel can be raised and expanded to a much larger diameter. The coiled tubing is then coiled onto the working reel from the shipping reel. The working reel is then used during the drilling or workover operations. The tubing is then coiled back onto the smaller diameter shipping reel for shipping from the well site, once the coiled tubing operations are complete. This limits the number of times that the large diameter tubing is coiled and uncoiled from the small diameter shipping reel, thereby minimizing the bending stress fatigue imposed on the tubing.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
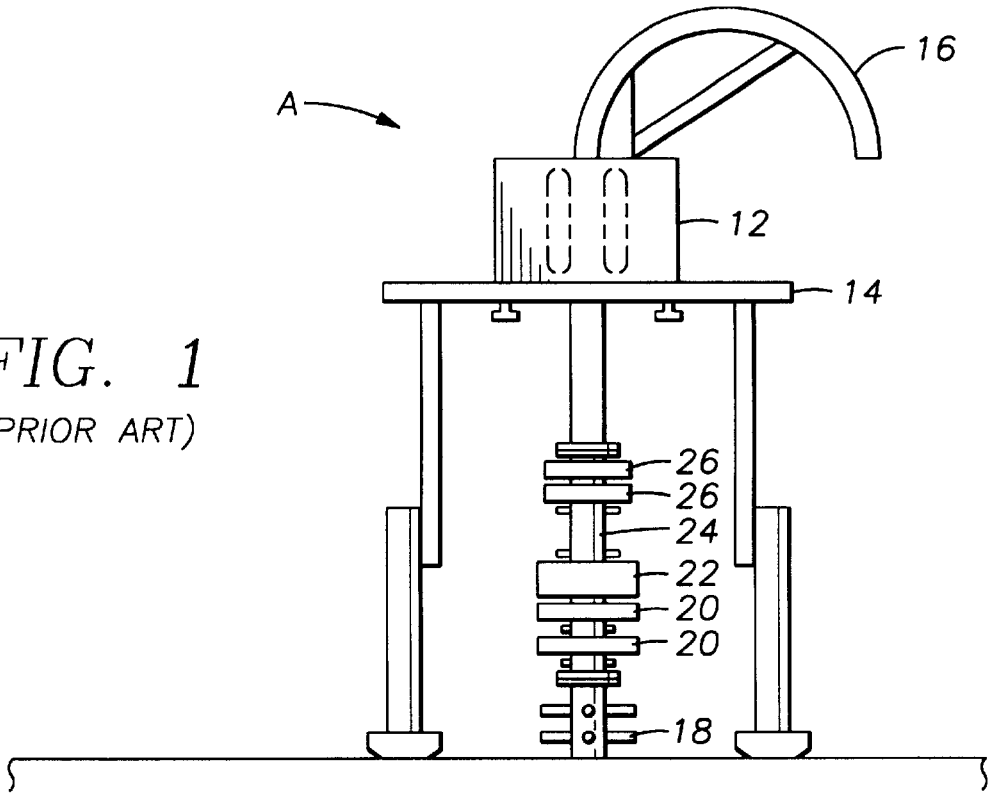
FIG. 1 (PRIOR ART)
FIG. 1 is a conventional prior art injector and gooseneck handling system.

Referring to FIG. 1, a conventional coiled tubing injection system A is shown. An injector head 12 is mounted on top of a working platform 14. An arcuate gooseneck 16 incorporating a tubing guide member is permanently mounted to the injector 12 in a fixed relationship. A typical well head assembly is shown beneath the working platform 14. The well head assembly comprises a master valve 18 mounted at the top of the well bore, a pair of shear rams 20, a blow-out preventer 22, a riser pipe 24, and a dual stripper 26.

Typically, a tubing string will have a bottom hole assembly (not shown) attached to the downhole end thereof, possibly including stabilizers, a drilling motor, and a drill bit or other tool. To assemble or disassemble the bottom hole assembly on the downhole end of the tubing in the typical injection system, the injector 12 and the gooseneck 16 must be removed from their spot on the working platform 14 above the well head with a crane (not shown). This gives personnel on the working platform access to the tubing and the bottom hole assembly, which they do not have when the injector is in its operative position mounted on the working platform.

Figure 2:
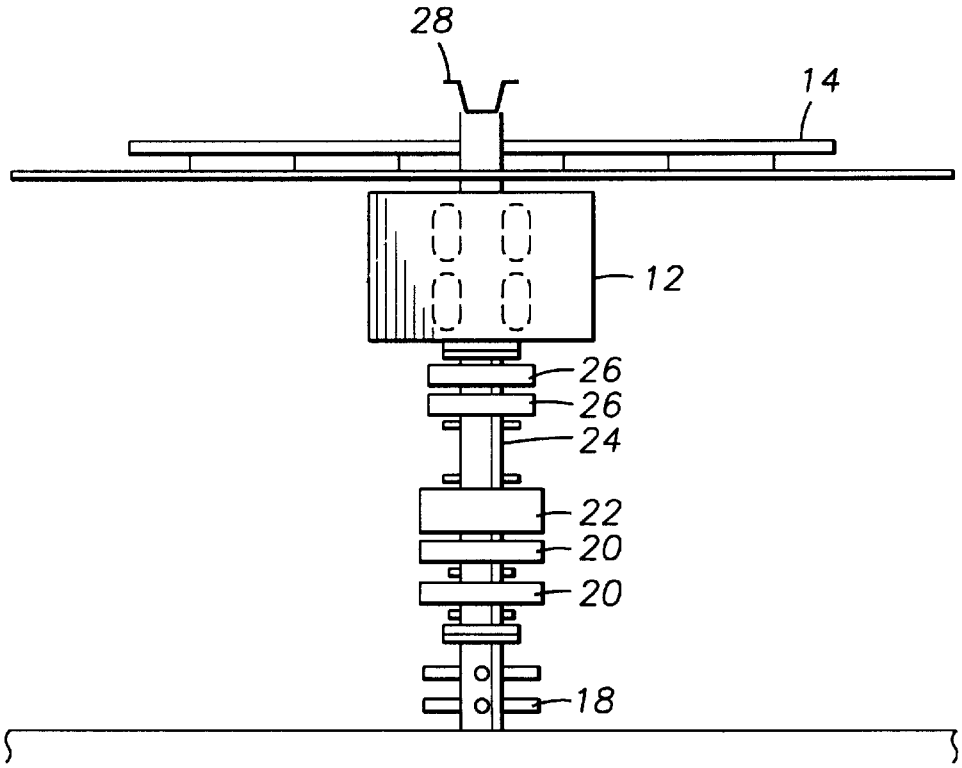
FIG. 2 is a schematic diagram of a first embodiment of the injection apparatus of the present invention.

FIG. 2 illustrates a first embodiment of the tubing injection apparatus of the present invention in its simplest form. The well head assembly is the same as described above, but the injector head 12 is mounted directly to and beneath the working platform 14, and a suitable pipe slip and centralizer assembly 28 is mounted at the top of the injector head 12.

The figure shows the injector head 12 schematically to include two sets of drive chains in series. This allows the injector head 12 to handle jointed pipe or other jointed tubulars. As a first set of drive chains grips and supports or moves the tubular, the second set of drive chains can be spread apart to allow the passage of a tube joint having an enlarged diameter. After the enlarged joint passes the second set of drive chains, the second set can be closed to grip the tubular while the first set can be opened to allow the enlarged joint to pass. It is to be understood that this type of injector head 12 can be used in every embodiment of the present invention, although some embodiments schematically show single sets of drive chains. Alternatively, two separate injector heads can be mounted in a series relationship to operate the same way, and such an arrangement should be considered identical to that described. This manner of injecting and pulling jointed tubulars is known in the art.

However, it is not known in the art to mount the injector head 12 beneath the working platform 14 to allow personnel access to the tubing and bottom hole assembly, atop the working platform, without removing the injector head. As shown, the injector head 12 is mounted directly on the well head assembly and beneath the working platform 14. The injector head 12 is not removed from this position on the well head assembly for any operation. Such a position is called herein the "operative" position of the injector head 12, that is, the position in which the injector head can "operate" to inject or pull tubulars into or out of the well bore. It will be seen below that in other embodiments, the "operative" position of the injector head 12 is not necessarily directly on the well head or beneath the working platform 14. However, in all embodiments, the "operative" position of the injector head 12 is one in which the injector head 12 can "operate" to inject or pull tubulars. Also, it will be seen that, in all embodiments, the relative positions of the injector head 12 and the working platform 14 are such that personnel access is provided atop the working platform 14 for assembly and disassembly of the bottom hole assembly. Further, it will be seen that all embodiments of the present invention are capable of injecting and pulling either coiled or jointed tubulars of various diameters.

The injector head 12 comprises a variable width drive mechanism as is currently known in the art, having variable size grippers therein to accommodate a range of varying diameters of jointed pipe, coiled tubing, casing, and tubing. Further, the injector head drive mechanism is capable of expanding to varying sizes to allow bottom hole assembly components including drilling motors, stabilizers, other accessories, and drill bits to pass therethrough.

With the injector head 12 permanently mounted on the well head beneath the working platform 14, and with the injector head 12 having the ability to pass bottom hole assembly components, jointed tubulars, and coiled tubing, tubing component handling is easily performed on the work platform 14 above the injector head 12 without interference. The tubing handling slip assembly 28, which can include a rotary table, if desired, is located above the longitudinal vertical axis of the injector head 12. Therefore, either jointed tubulars or bottom hole assembly components may be injected or pulled through the injector head 12, held in slips 28, and assembled or disassembled as required. Jointed tubing can be handled with a crane according to currently known procedures, and coiled tubing can be handled with equipment described below. Providing personnel access to the top end of the injector head 12 also allows for assembly or disassembly, from the bit up, of the bottom hole assembly when coiled tubing is being used. As mentioned above, all of these operations can take place while the injector head 12 is in its operative position.

Furthermore, this arrangement of the injector head 12 relative to the working platform 14 can allow deployment or retrieval of a bottom hole assembly in a pressurized well bore without incident, without requiring the use of a long lubricator assembly. While the bottom hole assembly is being made up in the slip assembly 28, the master valve 18 is closed, as well as the rams 20. The upper portion of the bottom hole assembly is connected to the jointed tubular or coiled tubing while the bottom hole assembly is supported by the slip assembly 28. When this connection has been made, the bottom hole assembly is lowered below the strippers 26, and the strippers 26 are closed around the tubular. The master valve 18 and the rams 20 are then opened. At this point, the bottom hole assembly can be run into the well. A reversed procedure is used to retrieve the bottom hole assembly. Any length of bottom hole assembly can be deployed and retrieved in this way without the use of a lubricator assembly, as long as a suitable length of riser pipe 24 is used. This also eliminates the need for a high lift of any injection equipment with a crane.

Figure 4:
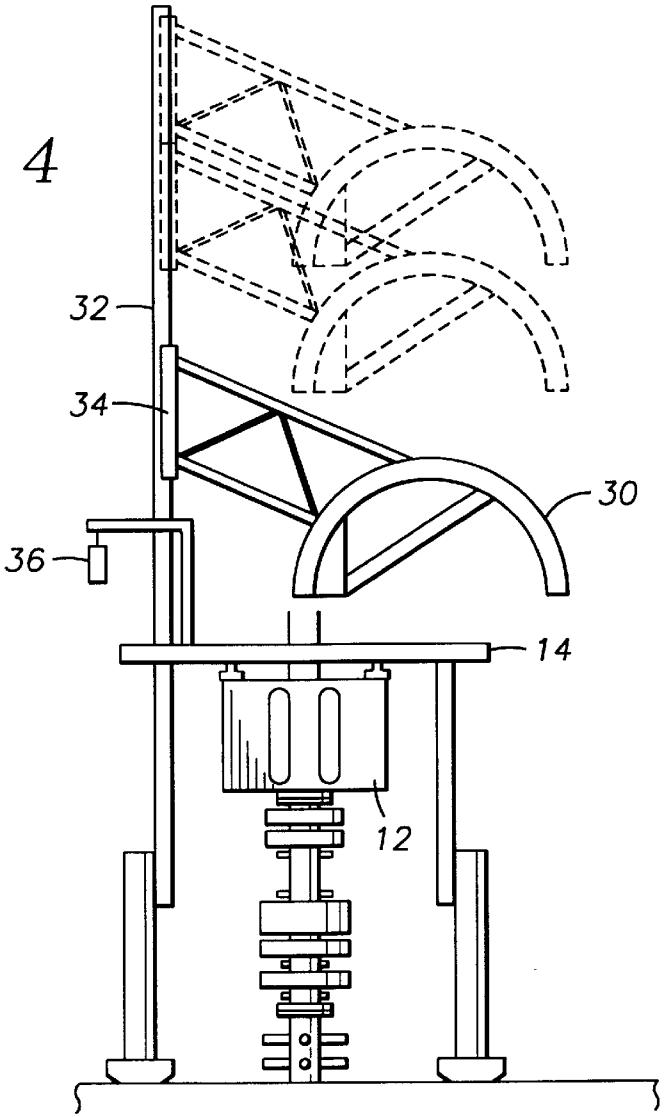
FIG. 4 is a schematic diagram of a gooseneck positioning apparatus of the present invention.
Figure 3:
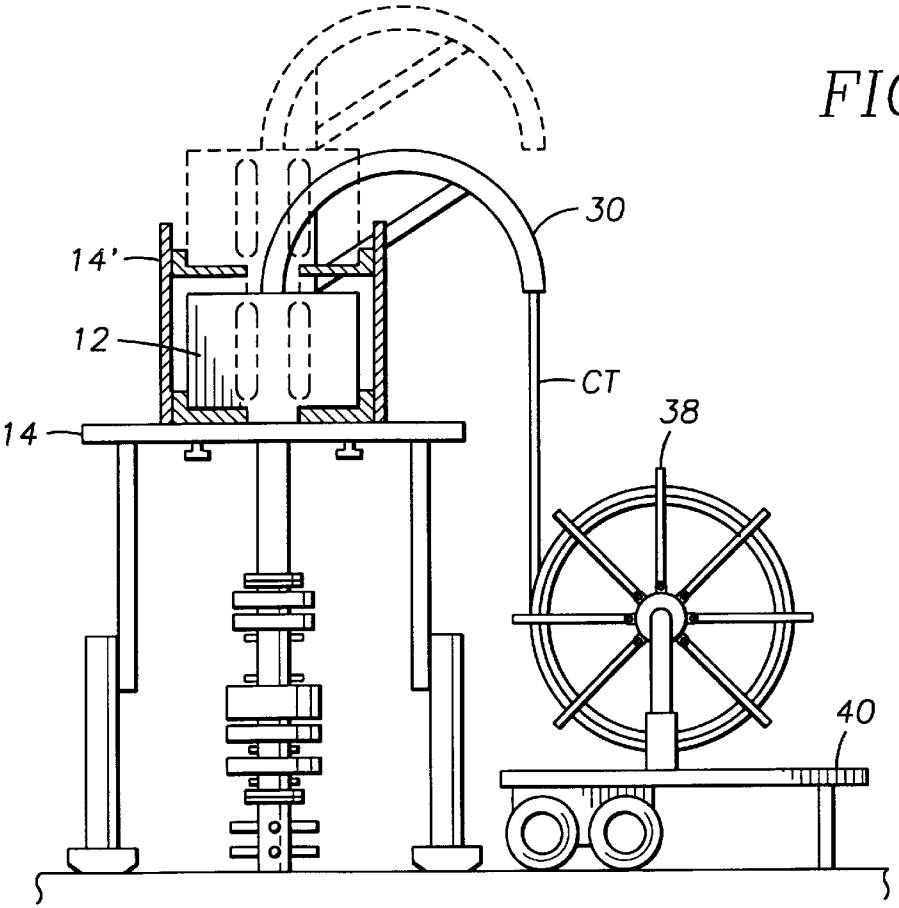
FIG. 3 is a schematic diagram of a second embodiment of the injection apparatus of the present invention.

Referring to FIGS. 3 and 4, one embodiment is shown of the coiled tubing handling equipment which can be used with the present invention. FIG. 3 also shows a slightly different arrangement of the injector head 12 and the working platform 14' from the embodiment shown in FIG. 2. Specifically, the injector head 12 in FIG. 3 is shown mounted in a vertically adjustable structure including a movable working platform 14' providing access above the injector head 12. The injector head 12 is mounted below the movable working platform 14' and above the stationary working platform 14. FIG. 4 shows the same injector head arrangement as shown in FIG. 2. In either arrangement, a gooseneck 30, including a curved tubing guide member, is movably mounted independently of the injector head 12 on a vertical mast 32, with the mast 32 not being shown in FIG. 3 for the sake of clarity. The gooseneck 30 is mounted on a vertically movable trolley 34 which is mounted on the mast 32. The mast 32 can include a hydraulic cylinder or other known means for moving the trolley 34 and the gooseneck 30 vertically. The gooseneck 30 can be raised and lowered to raise and lower the bottom hole assembly through the injector head 12 and the strippers 26 so that disassembly of the bottom hole assembly can be performed as described above, using a power tong 36. If it is desired to provide access to the coiled tubing CT and the bottom hole assembly on the stationary working platform 14, the injector head 12 and the movable platform 14' are raised, and the gooseneck 30 is raised. Alternatively, if it is desired to provide access to the coiled tubing CT and the bottom hole assembly on the movable working platform 14', only the gooseneck 30 is raised.

An important feature of the gooseneck 30 of the present invention is that it receives the coiled tubing CT from a coiled tubing reel 38 as the coiled tubing CT is being reeled therefrom substantially vertically. The term "coiled tubing" is used herein to refer to the jointless tubing dispensed from a reel, although it can be seen that at some points along its path, the tubing is substantially straight. The coiled tubing reel 38 is located spaced horizontally from the injector head 12, and it can be located at a lower level than the injector head 12. A reach of coiled tubing CT follows a substantially vertical tangent line from the reel 38 to a substantially tangent line at one end of the guide member of the gooseneck 30, causing the coiled tubing CT to straighten in the process. The gooseneck 30 deforms the straightened "coiled tubing" CT into an arc of a circle and directs the coiled tubing CT into the injector 12 substantially along the vertical axis of the injector 12, which substantially aligns with the vertical axis of the well bore and the well head equipment installed thereon. The radius of the arc of the gooseneck 30 is chosen to minimize the bending fatigue imposed on the coiled tubing CT, being substantially equal to the radius of the coiled tubing reel 38. For the largest sizes of coiled tubing in use, a radius of at least three meters, and preferably four meters, has been found to be suitable. In this manner, the deformation of the coiled tubing is minimized during injection and pulling operations. Further, the gooseneck 30 preferably comprises approximately a 180 degree arc, to insure full length support of the coiled tubing CT through the bend.

The gooseneck 30 may include a suitable limited drive assembly as is known in the art, to push the coiled tubing through the guide member. The gooseneck 30 remains substantially stationary with respect to the injector 12 during injection or pulling of the coiled tubing, but it can be raised above the injector 12 as discussed above for providing access to the bottom hole assembly. The gooseneck 30 can be removed or swung aside during jointed tubular operations.

Figure 5:
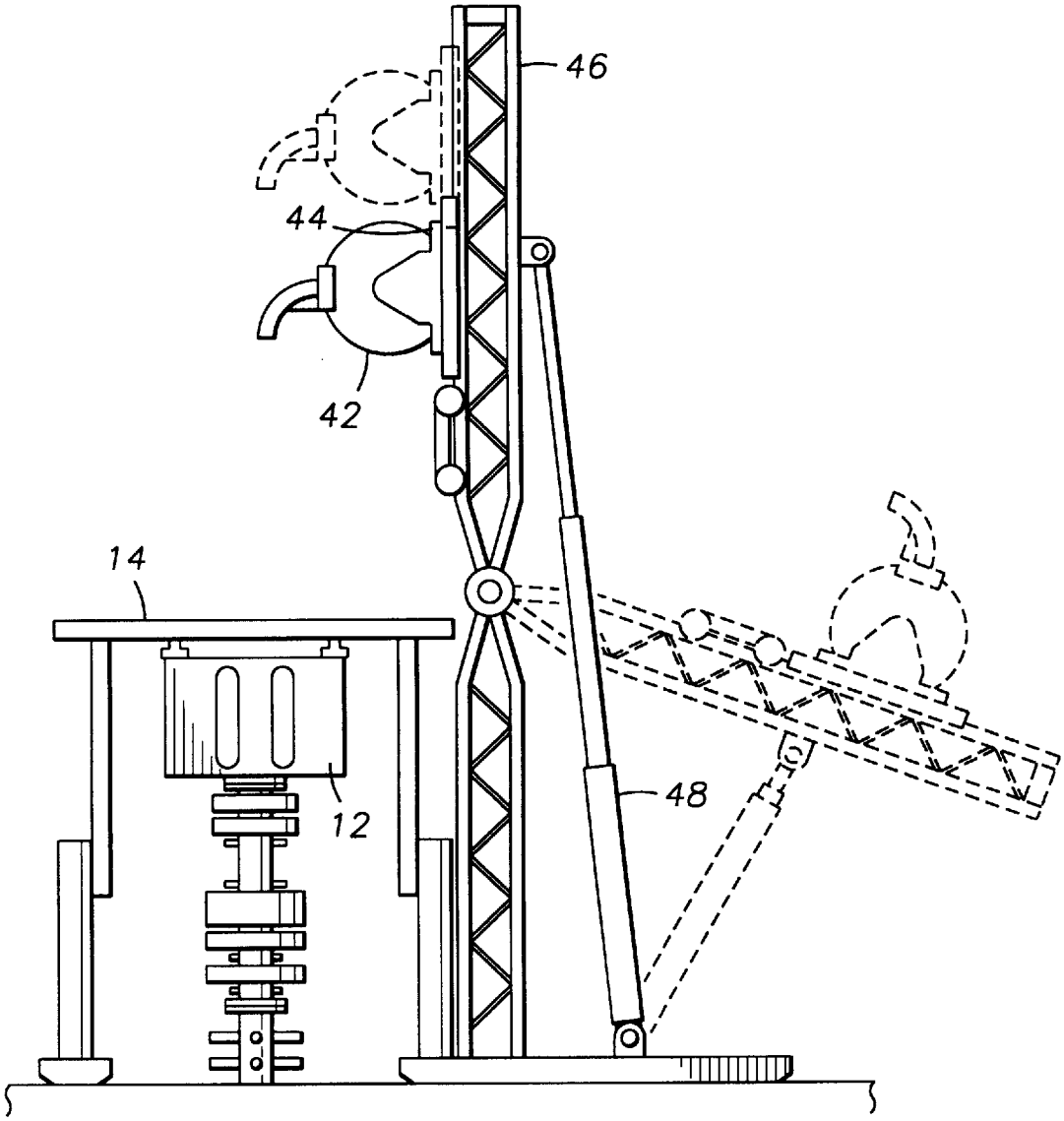
FIG. 5 is a schematic diagram of a reel positioning apparatus of the present invention.

Referring to FIG. 5, an alternative guidance system used in the present invention is shown. The injector head 12 is mounted below the working platform 14 as in FIG. 2. The injector head 12 has adjustable drive chains to allow the injector to handle varying sizes of coiled tubing and jointed tubing, as well as allowing a bottom hole assembly to pass therethrough.

The coiled tubing is mounted on a reel 42 mounted on vertically movable trolley 44 on the upper portion of a mast 46. To retrieve the bottom hole assembly from the wellhead, the injector head 12 pulls the coiled tubing from the well until the bottom hole assembly reaches the bottom of the injector head 12. The drive chains are then disengaged from the coiled tubing and spread apart to allow the bottom hole assembly to be pulled through the injector head 12. The reel 42 of coiled tubing is moved up the mast 46 by the trolley 44, pulling the bottom hole assembly through the injector 12 up to the working platform 14, where it may be disassembled from the bit up. When it is desired to mount or remove the reel 42 from the mast 46, the upper portion of the mast 46 may be pivoted down to a lower position as shown, by retraction of the hydraulic cylinder 48.

Figure 6:
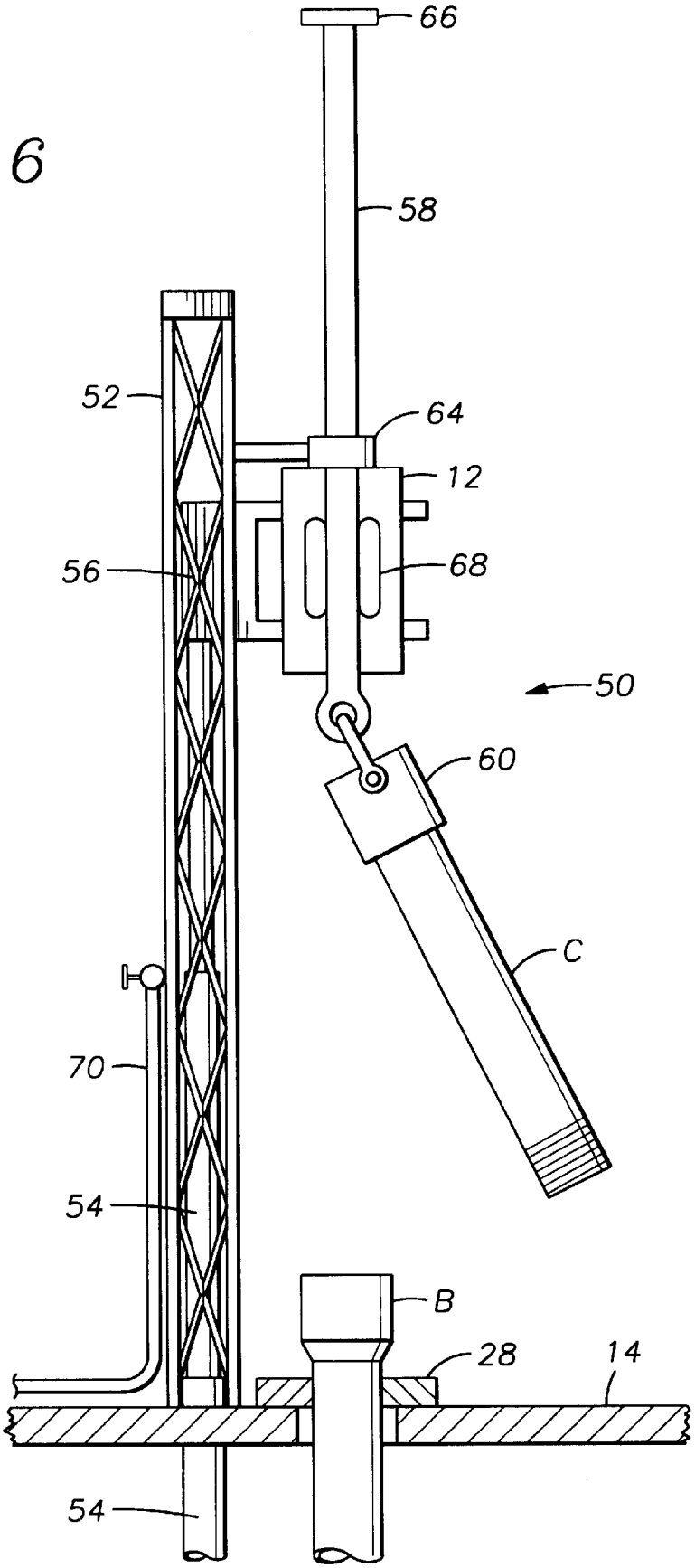
FIGS. 6 through 11 are schematic diagrams of a third embodiment of the injection apparatus of the present invention.

FIG. 6 shows another embodiment of the present invention, particularly suited for facilitating the handling of jointed tubulars, but also suited for handling coiled tubing. As seen in FIG. 6, the injection apparatus 50 includes a working platform 14, on which are mounted a slip assembly 28 for supporting the jointed pipe B in the well bore. The pipe B typically passes through a blow-out prevention assembly below the working platform 14. A mast 52 capable of supporting a load of 450,000 pounds or more is provided, as part of a support structure to which the working platform 14 is also mounted. A hydraulic cylinder 54 or other lifting device is provided, shown here being arranged within the mast 52. A trolley 56 is supported by the mast 52 and the hydraulic cylinder 54, with the vertical position of the trolley 56 being controlled by the cylinder 54. A chain drive injector head 12 is mounted to the trolley 56, above and aligned with the bore hole of the well.

Figure 10:
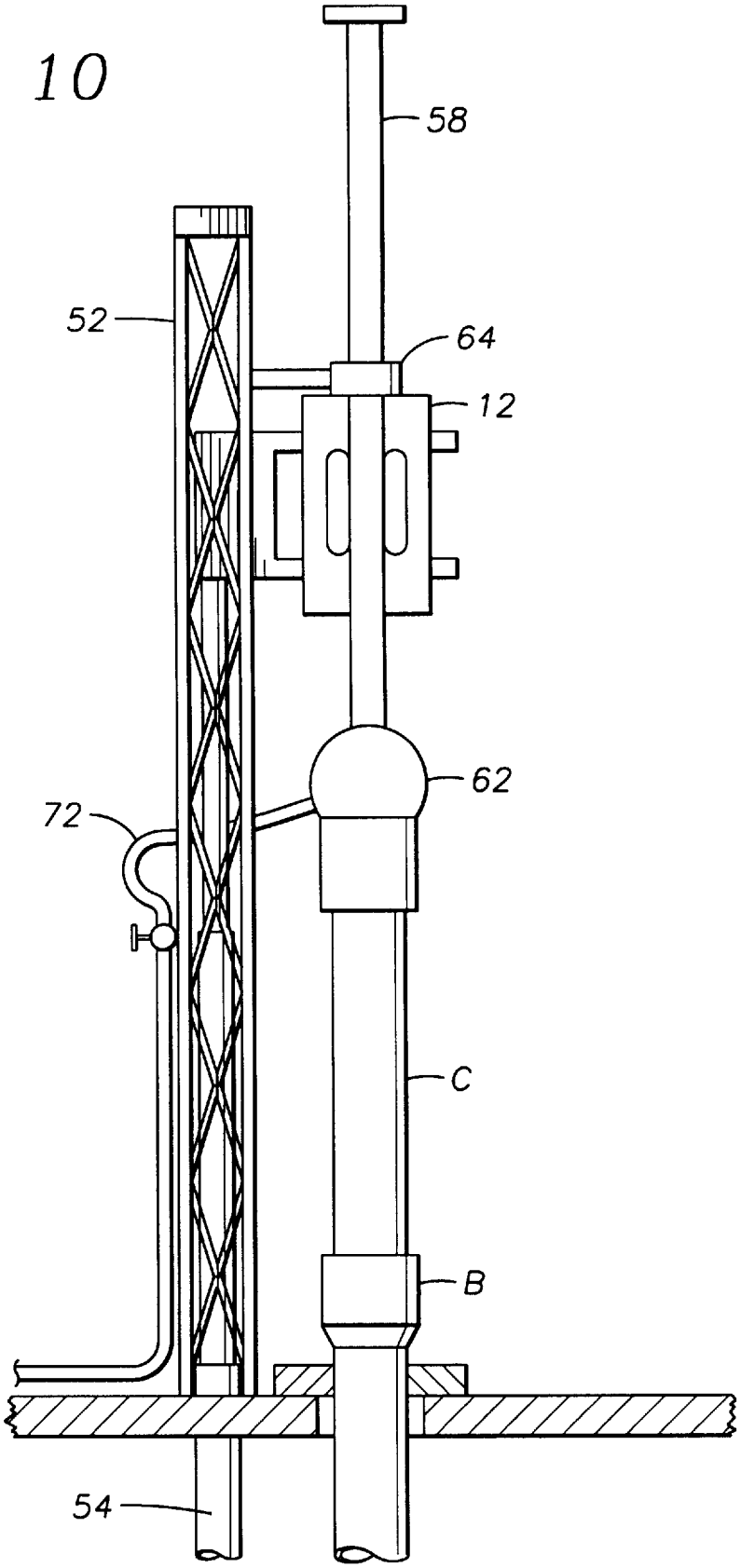

A working joint or mandrel 58 is removably assembled within the injector head 12, also aligned with the bore hole. An elevator and chuck assembly 60, or some other coupling device, is affixed to the lower end of the mandrel 58. A swivel assembly 62 as shown in FIG. 10 could also be used in place of the elevator assembly 60, such as when circulation of fluid through the pipe is required. Further, a combination assembly could incorporate the swivel function, the grappling function, and the circulation function if desired, without departing from the spirit of the present invention. A back up arm 64 is provided for absorbing torque by transferring torque to the mast 52, to prevent a torque load on the injector head 12. Other means of absorbing torque could also be used. A safety collar 66 is attached to the upper end of the mandrel 58 to prevent the mandrel 58 from slipping through the injector head 12.

A fluid standpipe 70 is provided near the mast 52, for providing pressurized fluid for circulation through the pipe in selected circumstances. As shown in FIG. 6, the standpipe 70 is valved off and not connected for circulation. When circulation is desired, the standpipe 70 can be connected to the swivel 62 by a flexible circulation hose 72, as shown in FIG. 10.

Drive chains 68 are shown schematically in the injector head 12, in drive contact with the mandrel 58. The trolley 56 is positioned by the cylinder 54 at a height suitable to allow handling of a desired length of jointed pipe. The length of the mandrel 58 is also selected to allow injection of the desired length of jointed pipe. A first section of pipe B is shown in the well bore, and a second section of pipe C is shown having just been picked up by the elevator and chuck assembly 60. The mandrel 58 is positioned near its highest location by the injector head 12 to allow the second section of pipe C to be swung over and aligned with the first section of pipe B.

Figure 7:
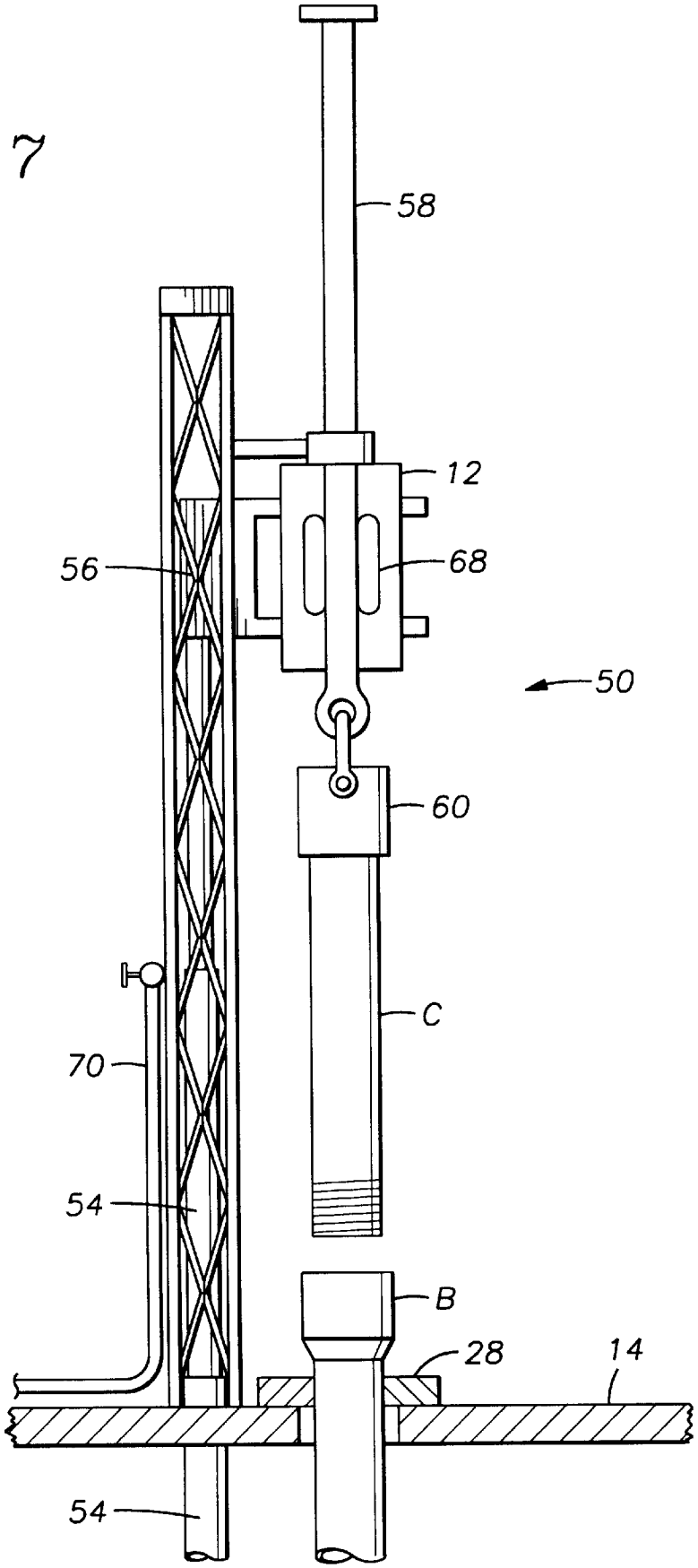
Figure 8:
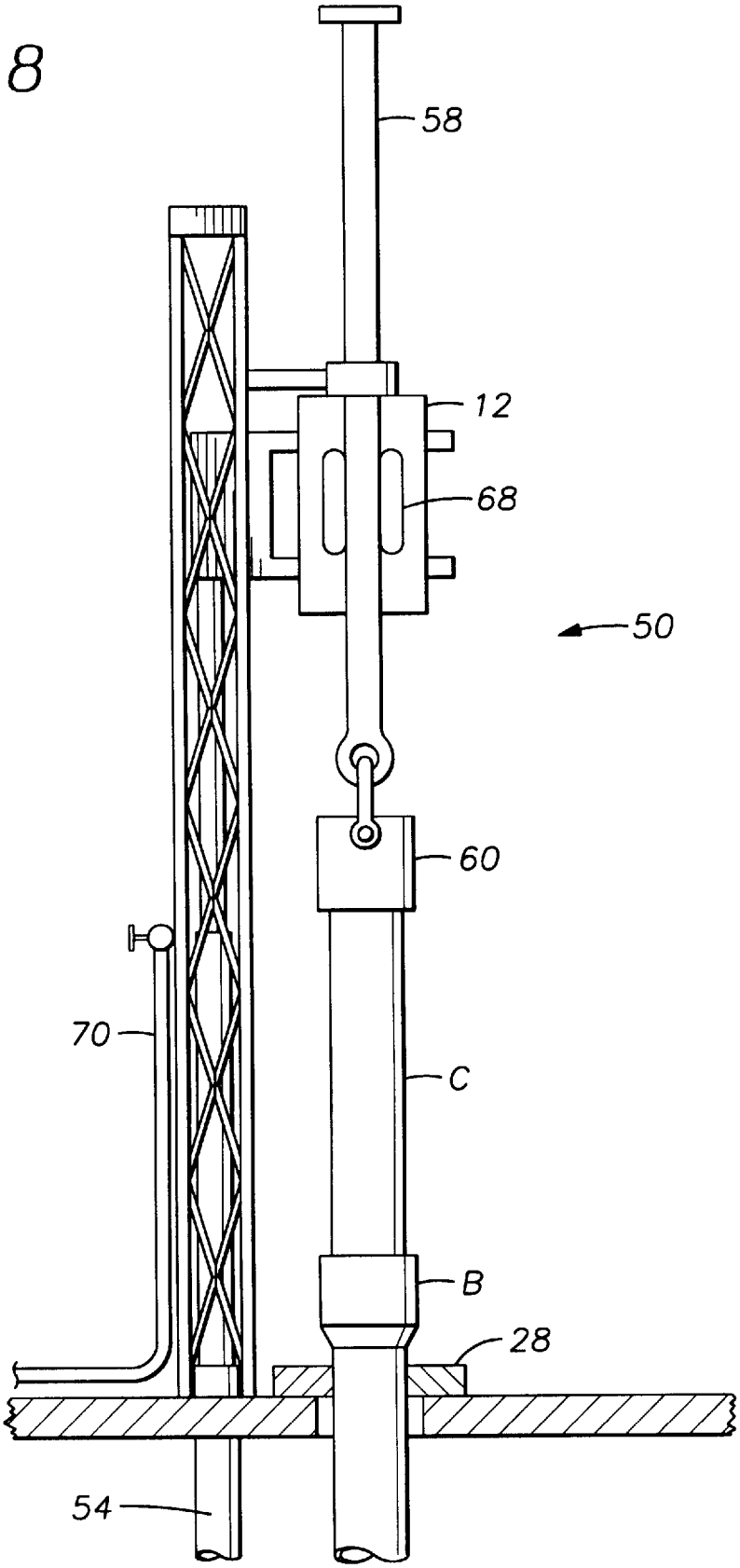

FIG. 7 shows the second section of pipe C aligned with the upper end of the first section of pipe B for stabbing into the pipe B and makeup. The mandrel 58 is still at its highest point. FIG. 8 shows the second section of pipe C having been lowered into and made up with the upper end of the first section B. This was accomplished, as can be seen, by the lowering of the mandrel 58 to an intermediate location by the injector head 12. The elevator and chuck assembly 60 allows for rotation of the second section of pipe A to make up the threads. Alternatively, the swivel assembly 62 could be used for this purpose, as well as other alternative equipment which can accomplish the grappling function while allowing rotation of the pipe C.

Figure 9:
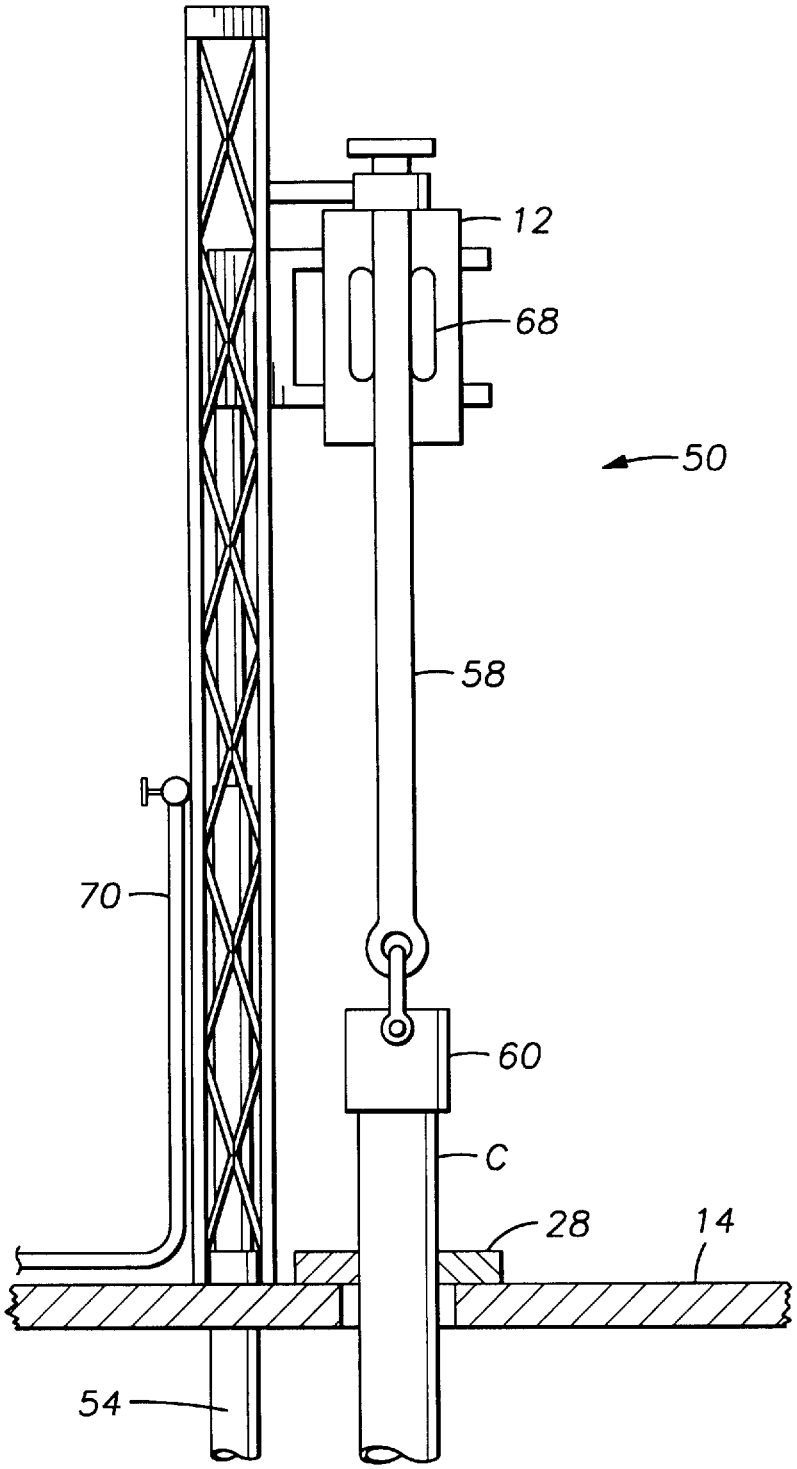

FIG. 9 shows the second section of pipe C having been lowered into the well head assembly by lowering of the mandrel 58 to a lowermost position with the injector head 12. At this point, the slips 28 can be activated to grip the string of pipe and allow disconnection of the elevator assembly 60, or the swivel 62 if used, in preparation for picking up another section of pipe. A reversed procedure would be used to remove pipe from the well bore.

As mentioned above, FIG. 10 shows an alternative configuration in which the elevator and chuck assembly 60 has been replaced by a swivel assembly 62. Also, the circulation line 72 has been attached to the swivel assembly 62 for circulation of fluid such as drilling fluid through the pipe string. This can be called for to "float" the pipe into the well bore, or to accomplish drilling, such as by operating a downhole motor. A rotary table could be used on the working platform 14, and a kelly could be installed below the swivel assembly 62, as is known in the art, to rotate the pipe if desired for conventional drilling. Room for the kelly would be provided by positioning the injector head 12 higher on the mast 52.

Figure 11:
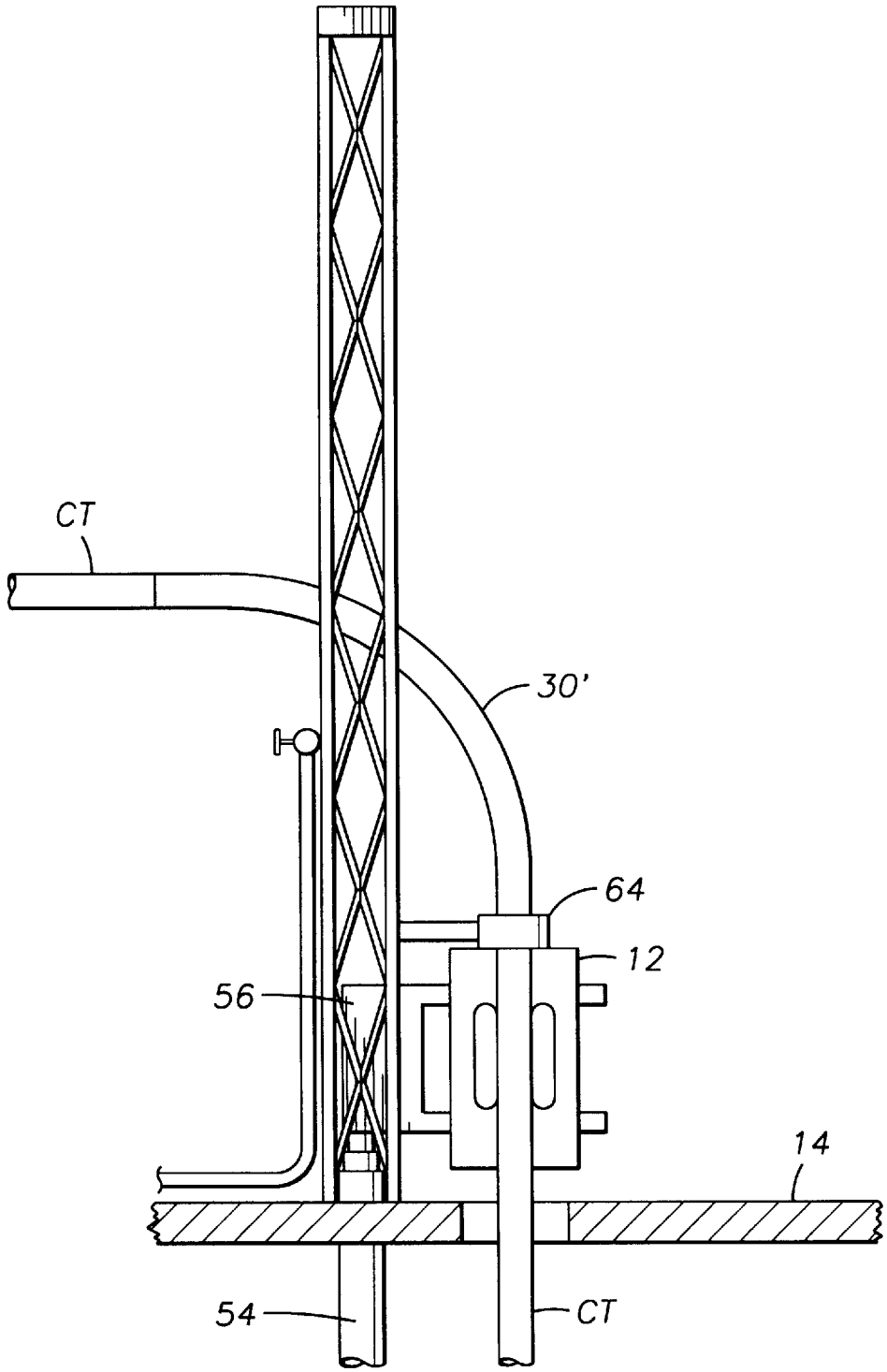

FIG. 11 illustrates how the apparatus is configured to accomplish coil tubing injection and withdrawal. The slips 28 have been removed, along with the circulation hose 72, and the mandrel 58. The hydraulic cylinder 54 has been lowered to position the injector head 12 at the working platform 14. A coiled tubing guide 30' has been mounted to the injector head 12 for guiding the coiled tubing CT from the reel 38 to the upper end of the injector head 12. Access to the bottom hole assembly can be provided by raising the trolley 56 and the injector head 12 with the hydraulic cylinder 54.

Figure 12:
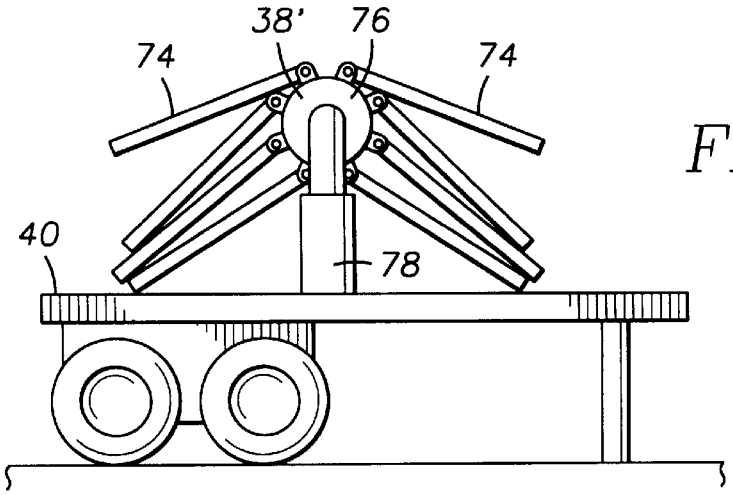
FIGS. 12 through 14 are schematic diagrams of an expandable coiled tubing reel apparatus of the present invention.
Figure 13:
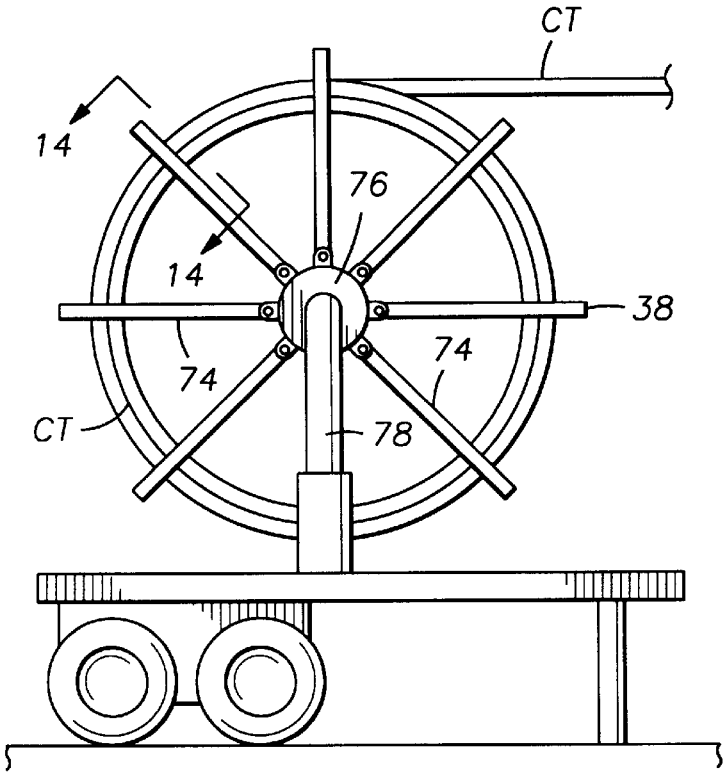
Figure 14:
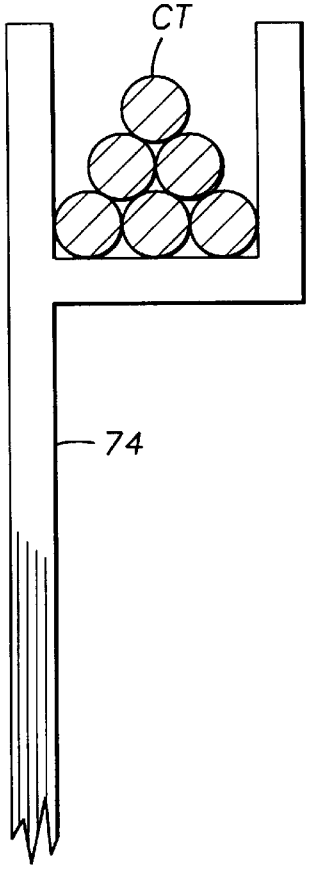

FIGS. 12, 13, and 14 show an assembly which can be used as part of the present invention to minimize bending fatigue of the coiled tubing. As discussed earlier, the size of the coiled tubing reel used to ship the coiled tubing to the well site is limited by regulations governing the roads over which the tubing is shipped. Once at the well site, the coiled tubing can be unreeled from the shipping reel and reeled onto a large diameter expandable working reel 38'. The expandable reel 38' has a central hub 76 mounted on a hydraulic cylinder 78, which is mounted on the trailer 40. A plurality of spokes 74 are pivotably mounted to the hub 76. During shipping of the working reel 38' to the well site, the spokes 74 are collapsed to rest on the trailer 40, and the hydraulic cylinder 78 is lowered, to lower the hub 76, as shown in FIG. 12. Once at the well site, the hydraulic cylinder 78 raises the hub 76 to an operative position, and the spokes 74 are positioned radially from the hub 76 and locked into place as shown in FIG. 13. Gussets, pins, or other supports (not shown) can be used to hold the spokes in place. The coiled tubing CT is then reeled onto the working reel 38'. The length of the spokes 74 can be chosen to give the reel 38' a radius large enough to minimize the bending fatigue of the coiled tubing CT during reeling and unreeling. A reel radius of up to twenty feet is possible with this apparatus. FIG. 14 shows a detail of the outer ends of the spokes 74, to illustrate the placement of the coiled tubing CT on the expanded reel 38'.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for providing a large radius coil of tubing at a well site, to minimize repetitive bending stress on said tubing during injection and pulling of said tubing into and out of a well bore, said apparatus comprising:

a shipment vehicle for supporting and holding coiled tubing during shipment to a well site;

a shipping reel mounted on said shipment vehicle, said shipping reel having a first diameter;

a handling vehicle for supporting and handling coiled tubing during injection and pulling of the tubing;

an expandable working reel mounted on said handling vehicle, said expandable working reel being expandable to a second diameter larger than said diameter of said shipping reel; and apparatus for uncoiling the tubing from said shipping reel and coiling the tubing on said working reel at the well site.

2. An apparatus as recited in claim 1, wherein said working reel comprises:

a hub, said hub being mounted on said handling vehicle with the axis of said hub being substantially horizontal; and a plurality of spokes pivotably mounted to said hub, said spokes being pivotable to a first collapsed configuration to reduce the height of said working reel, said spokes being pivotable to a second radial position to expand said working reel to said second diameter, said spokes being fixable in said second radial position, said spokes being arranged in a substantially vertical common plane in said second radial position;

said apparatus further comprising a lifting device on said handling vehicle for raising said working reel to a sufficient height above said handling vehicle to allow expansion of said working reel to said second diameter.

3. An improved coiled tubing apparatus for minimizing repetitive bending stress on coiled tubing while running coiled tubing into and out of a well bore, said apparatus comprising a working reel mounted with its axis substantially horizontal, said working reel being adapted to collapse to a small vertical dimension for shipping to a well site without coiled tubing mounted thereon, and said working reel being adapted to expand to a larger vertical dimension for coiling of tubing thereon at a relatively larger coil diameter, to minimize repetitive bending stress in the tubing while reeling in and playing out of coiled tubing at the well site.

4. The improved coiled tubing apparatus of claim 3, further comprising a reel support adapted to rotatably carry said working reel at a sufficient height to allow vertical expansion of said working reel prior to coiling of tubing thereon at said relatively larger coil diameter, to minimize repetitive bending stress in the tubing while reeling in and playing out of the tubing.

5. An improved coiled tubing apparatus as recited in claim 3, wherein said working reel comprises a plurality of spokes positionable in a first arrangement to configure said working reel in said small vertical dimension, said spokes being positionable in a second arrangement to configure said working reel in said larger vertical dimension.

6. An improved coiled tubing apparatus as recited in claim 5, further comprising a hub, said hub being mounted with the axis of said hub being substantially horizontal, wherein each said spoke is pivotable about said hub in a common vertical plane, each said spoke lying substantially horizontal in said first arrangement, said spokes extending substantially radially from said hub in a common vertical plane in said second arrangement.

7. An improved coiled tubing apparatus as recited in claim 6, further comprising at least one channel formed on an outer end of each said spoke to retain a coil of tubing on said reel.

8. An improved coiled tubing apparatus as recited in claim 7, further comprising a plurality of said channels on said outer end of each said spoke, for retaining a plurality of coils of tubing on said reel.

9. A method for minimizing repetitive bending stress on coiled tubing during injection and pulling of said tubing into and out of a well bore, said method comprising:

shipping coiled tubing to a well site coiled on a shipping reel;

providing an expandable working reel mounted on a handling vehicle;

collapsing a transverse dimension of said working reel;

transporting said working reel to the well site;

expanding said working reel to a diameter greater than said collapsed transverse dimension, said expanded diameter of said working reel being greater than the diameter of said shipping reel;

uncoiling said tubing from said shipping reel at the well site and coiling said tubing onto said expanded working reel at said second, greater, diameter.

10. A method as recited in claim 9, wherein said working reel comprises a hub mounted with the axis of said hub being substantially horizontal, and a plurality of spokes pivotably mounted to said hub, said method further comprising:

pivoting said spokes to a first collapsed configuration to reduce the height of said working reel for transporting said working reel to the well site;

raising said working reel to a sufficient height above said handling vehicle, at the well site, to allow vertical expansion of said working reel to said second diameter; and pivoting said spokes to a second radial position in a substantially vertical common plane, to vertically expand said working reel to said second diameter.

* * * * *